US006953165B1

(12) United States Patent
Griebat et al.

(10) Patent No.: US 6,953,165 B1
(45) Date of Patent: Oct. 11, 2005

(54) CORN MILLING PROCESS

(75) Inventors: John Griebat, Atchison, KS (US); David Strief, Palo, IA (US)

(73) Assignee: The Quaker Oats Company, Chicago, IL (US)

( * ) Notice: Subject to any disclaimer, the term of this patent is extended or adjusted under 35 U.S.C. 154(b) by 197 days.

(21) Appl. No.: 09/661,136

(22) Filed: Sep. 13, 2000

(51) Int. Cl.[7] ..... B02C 9/04
(52) U.S. Cl. ..... 241/11
(58) Field of Search ..... 241/6–12, 13

(56) References Cited

U.S. PATENT DOCUMENTS

| | | | | |
|---|---|---|---|---|
| 1,117,963 A | | 11/1914 | Pollock | |
| 2,392,365 A | | 1/1946 | Carter | |
| 2,460,389 A | | 2/1949 | Lloyd et al. | |
| 2,464,212 A | | 3/1949 | Carter et al. | |
| 3,399,839 A | | 9/1968 | Anderson et al. | |
| 3,606,918 A | | 9/1971 | Sian | |
| 4,133,899 A | | 1/1979 | Wolffing et al. | |
| 4,181,748 A | | 1/1980 | Chwalek et al. | |
| 4,189,503 A | | 2/1980 | Giguere | |
| 4,301,183 A | | 11/1981 | Giguere | |
| 4,365,546 A | | 12/1982 | Giguere | |
| 4,773,601 A | * | 9/1988 | Urich et al. | 241/101.761 |
| 5,025,993 A | * | 6/1991 | Satake | 241/74 |
| 5,036,757 A | * | 8/1991 | Mueller | 99/519 |
| 5,114,079 A | * | 5/1992 | Curran | 241/3 |
| 5,154,363 A | * | 10/1992 | Eddy | 241/30 |
| 5,198,035 A | | 3/1993 | Lee et al. | |
| 5,205,496 A | * | 4/1993 | O'Donnell et al. | 241/34 |
| 5,250,313 A | | 10/1993 | Giguere | |
| RE35,202 E | | 4/1996 | Baltensperger et al. | |
| 5,547,133 A | * | 8/1996 | Rogers et al. | 241/9 |
| 5,795,222 A | * | 8/1998 | McLeod | 460/97 |
| 5,979,808 A | * | 11/1999 | Vogelgesang | 241/236 |
| 6,422,937 B1 | * | 7/2002 | McLeod et al. | 460/12 |

FOREIGN PATENT DOCUMENTS

| | | |
|---|---|---|
| AT | 380 183 | 4/1986 |
| DE | 3710602 | 11/1987 |
| EP | 0 418 801 | 3/1991 |
| EP | 0 958 863 | 11/1999 |

* cited by examiner

*Primary Examiner*—Mark Rosenbaum
(74) *Attorney, Agent, or Firm*—Lars S. Johnson; James D. Ryndak

(57) ABSTRACT

The present invention is a short flow milling process wherein finished product is rapidly isolated and removed from the milling process flow regime at early stages. The minimization of handling and the minimization or elimination of intermixing streams of various size gradations prevents size contamination that otherwise necessitates further sifting. Component parts are eliminated along with the accompanying handling and transfer equipment to create a compact and efficient milling regime. The size reductions enable the invention to be practiced in a mobile form. Therefore, the present invention relates also to a method for providing a mobile mill process.

11 Claims, 6 Drawing Sheets

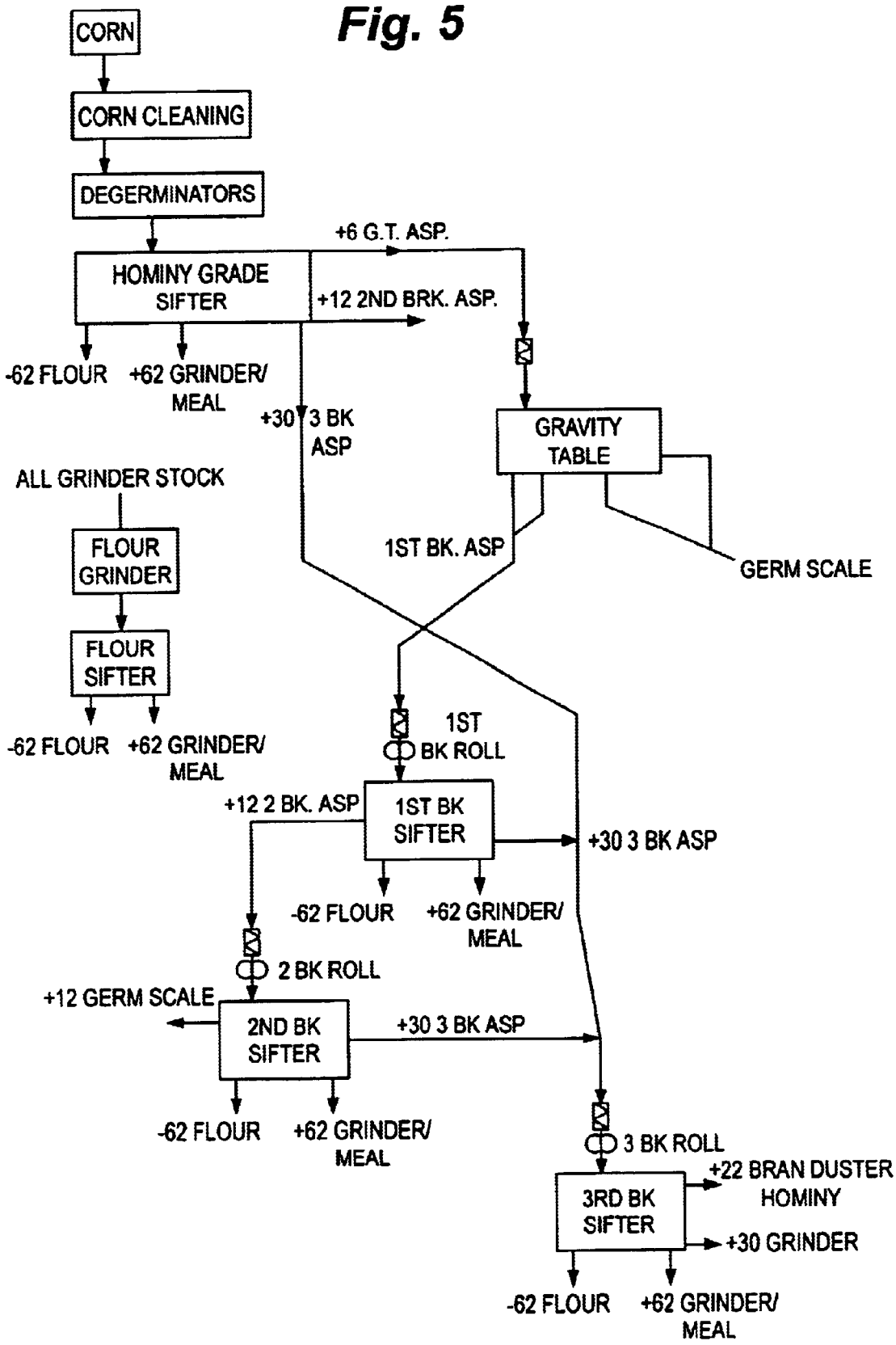
Fig. 5
CORN
CORN CLEANING
DEGERMINATORS
HOMINY GRADE SIFTER
+6 G.T. ASP.
+12 2ND BRK. ASP.
-62 FLOUR
+62 GRINDER/ MEAL
+30 3 BK ASP
GRAVITY TABLE
ALL GRINDER STOCK
FLOUR GRINDER
FLOUR SIFTER
-62 FLOUR
+62 GRINDER/ MEAL
1ST BK. ASP
GERM SCALE
1ST BK ROLL
+12 2 BK. ASP
1ST BK SIFTER
+30 3 BK ASP
-62 FLOUR
+62 GRINDER/ MEAL
2 BK ROLL
+12 GERM SCALE
2ND BK SIFTER
+30 3 BK ASP
-62 FLOUR
+62 GRINDER/ MEAL
3 BK ROLL
+22 BRAN DUSTER HOMINY
3RD BK SIFTER
+30 GRINDER
-62 FLOUR
+62 GRINDER/ MEAL

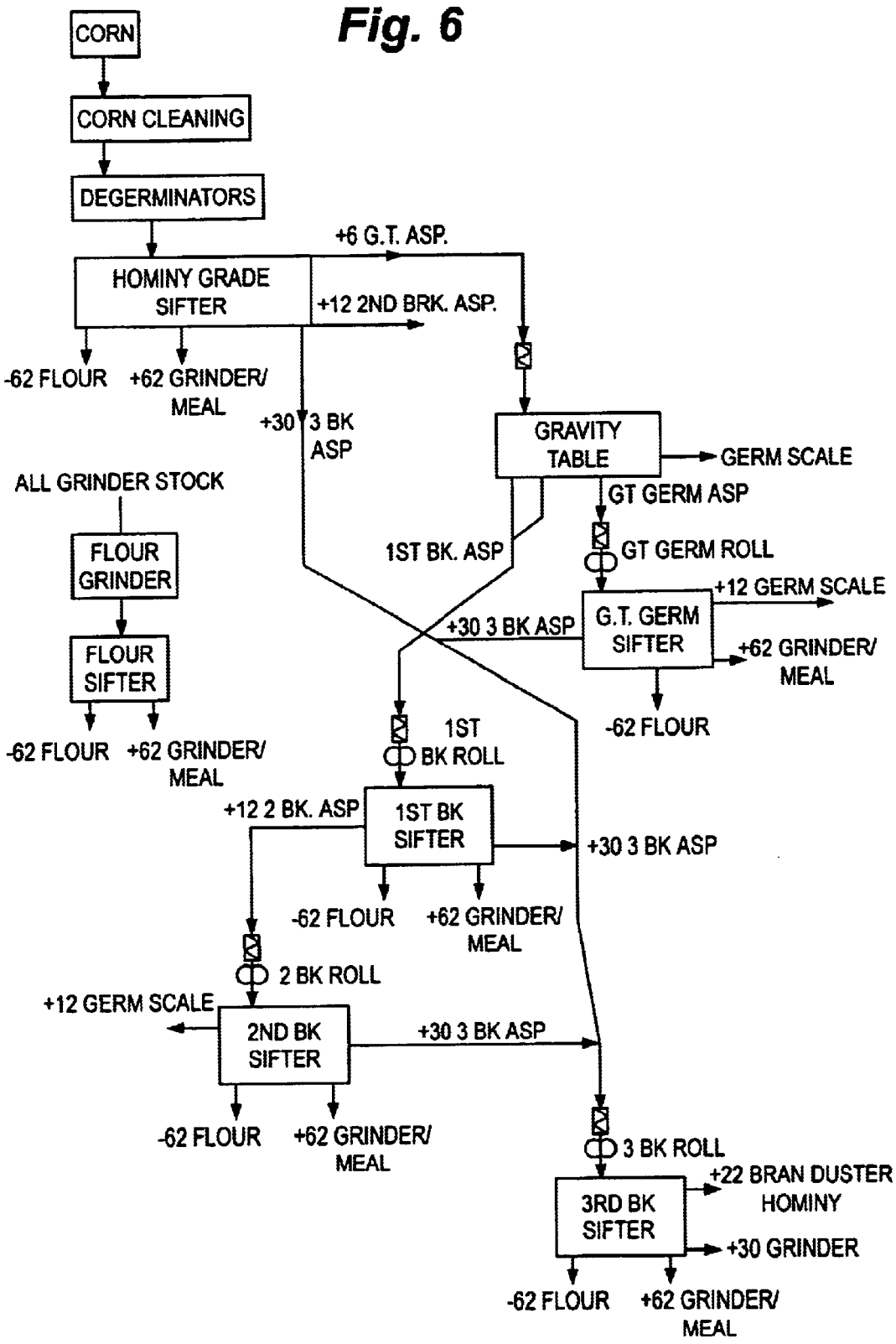
Fig. 6
CORN
CORN CLEANING
DEGERMINATORS
HOMINY GRADE SIFTER
+6 G.T. ASP.
+12 2ND BRK. ASP.
-62 FLOUR
+62 GRINDER/ MEAL
+30 3 BK ASP
GRAVITY TABLE
GERM SCALE
GT GERM ASP
ALL GRINDER STOCK
FLOUR GRINDER
FLOUR SIFTER
-62 FLOUR
+62 GRINDER/ MEAL
1ST BK. ASP
GT GERM ROLL
+12 GERM SCALE
+30 3 BK ASP
G.T. GERM SIFTER
+62 GRINDER/ MEAL
-62 FLOUR
1ST BK ROLL
+12 2 BK. ASP
1ST BK SIFTER
+30 3 BK ASP
-62 FLOUR
+62 GRINDER/ MEAL
2 BK ROLL
+12 GERM SCALE
2ND BK SIFTER
+30 3 BK ASP
-62 FLOUR
+62 GRINDER/ MEAL
3 BK ROLL
+22 BRAN DUSTER HOMINY
3RD BK SIFTER
+30 GRINDER
-62 FLOUR
+62 GRINDER/ MEAL

CORN MILLING PROCESS

BACKGROUND OF THE INVENTION

The corn kernel, illustrated in FIG. 1, has a number of components, each being best suited for various uses. The process of modern dry corn milling seeks to segregate and separately process the below-identified parts of a kernel of corn as each part has a separate use. The hard outer shell is called the pericarp or the bran coat. The end of the corn kernel which adheres it to the corn cob is called the tip cap. The interior of the corn kernel consists of the endosperm and the germ. The endosperm is generally broken into two parts: soft endosperm and hard endosperm. For purposes of human consumption, the hard endosperm generally produces grits and corn meal, and the soft endosperm generally produces corn flour. The germ contains a much higher percentage of fat compared to the other parts of the kernel and is the source of corn oil.

Corn milling is an ancient practice to the human race, dating back many, many years. Historically, mill stones were utilized to grind the corn into meal. Wind and water powered mills developed several hundred years ago allowed for increased efficiency in the processing of corn. For the last hundred years or so, milling operations have utilized roll milling equipment in an effort to separate the components of the corn kernel for more particularized uses.

Modern roll milling equipment utilizes contiguous rollers with varying sized corrugations and varying sized roller gap spacings to achieve the desired particle size fractionation. Typically, mills employ rollers in series with increasingly narrow gaps in a gradual milling process. More specifically, the various parts of the corn kernel are segregated and removed to differing processing pathways, often referred to as streams. Initially, after cleaning the hard outer shell, the kernel is fractured via a mechanical process thereby freeing and removing the germ from the remaining parts of the kernel—a step called degermination. The remaining parts of the kernel are broken up by a series of rollers. As this material is processed, the hard outer shell is removed in the form of bran flakes, and the remaining soft and hard endosperm are further separated into differing streams by passing through a series of rollers and sifters which separate product by particle size. The end products of the dry corn milling operation are bran, grits, meal, flour, and high fat germ.

A flow scheme typical of prior art mills is illustrated in U.S. Pat. No. 5,250,313. In FIG. 5 of the '313 patent (reproduced herein as FIG. 2), the incoming corn is cleaned, washed, tempered to the appropriate moisture content, fractured or degerminated, and dried. Various designs exist to carry out the step of degermination. For example, the Ocrim degerminator uses a spinning rotor having combination blades to operate against a horizontal, perforated cylinder that only allows partial kernels to pass. The rotor and breaker bars are set to break the corn against a spiral rotor bar and a cutting bar. Another known degerminator is the Beall degerminator. In the Beall degerminator, grinding occurs through an abrasive action of kernel against kernel, and kernel against a nested conical surface and screen. Impact-type degerminators are also used. An example is the Entoletor degerminator as illustrated in FIG. 3. The Entoletor includes a vertical drive shaft that operates a rotor. Kernels are fed downwardly towards the rotor where they are forced outwardly by centrifugal motion to impact a liner surface.

Generally, the product out of the degerminator is separated into a first stream which is relatively rich in endosperm and a second stream which is relatively rich in germ and bran. Specifically, with reference again to FIG. 2, the degerminated corn is aspirated to effect initial density separation of the fractured kernel. The tailings and liftings from the aspirators are further separated through additional aspiration or the use of gravity tables. In general, bran, whole germ and germ contaminated particles obtained via density separation are lighter than other constituent parts and may be partially removed via gravity separation to be directed through a series of germ rollers and sifters. Separated, primarily endosperm-containing streams from the gravity tables and aspirators may be directed to different break rollers depending on the particle size of the stream. For example, those primarily endosperm-containing streams having smaller particle sizes may be directed past the first and second break rollers, or as illustrated in FIG. 2, beyond to later break rollers.

The "break rollers" used in a gradual break process typically comprise corrugated rollers having roller gaps that cascade from wider roller gaps for the $1^{st}$ break roller to more narrow roller gaps for subsequent break rollers. Roller gaps are the spacings between the exterior or "tip" portions of the corrugations on opposing rollers. The use of 5 break rollers is typical, and roller gaps may vary depending on the desired finished product. Typical roller gap distances on prior art systems range from about 0.01 to about 0.07 inches, wherein smaller gaps result in finer particles. In general, the break rollers are operated such that opposing corrugated roller faces rotate at differing rates. FIG. 4 contains examples of typical prior art roller corrugation configurations. Most configurations present a sharp edge and a dull edge as determined by the slope of the corrugation surface. Therefore, breaking may occur under a sharp to sharp, sharp to dull, dull to sharp, or dull to dull arrangement of opposing corrugations.

After break rolling, the further-broken particles are separated, typically by a sifting process. From there, larger particles are further rolled in a subsequent break roller (and the further-broken particles are again sifted), or they are passed on to drying or cooling steps or additional sifting steps to isolate finished products (flour, meal, grits, etc.). Typical finished-product requirements may be found generally in 21 CFR §§ 137.215–285 (1993). Of course other products may be desired by particular purchasers. The remaining particles that fail to pass the post germ sifting steps are typically sent to a germ handling process (labeled oil recovery in FIG. 2). The finer particles obtained from the germ roller siftings are processed in a manner generally similar to the finer particles from the break rollers.

Traditionally, large scale corn mills have employed a great degree of redundancy and repetitive processing of the grain. For example, as illustrated in FIG. 2, a traditional corn milling process involves an initial degermination step, followed by five separate roller, or breaking, steps each of which is followed by sifting steps. In addition, the prior art includes various shorter mill processes wherein fewer roller steps are utilized, germ streams are extracted from the mill stream earlier in the process, and valuable capital, space and time savings are achieved. See for example the process described in the '313 patent. The shortened mill regimes also dramatically reduce production expense by lowering the labor costs associated with the milling process due to the reduced maintenance and monitoring required of a much shorter process.

Nevertheless, even in the prior art "shortened" mill flow regimes, inefficiencies remain. For example, U.S. Pat. No. 4,189,503 (a parent from which the '313 patent is a continuation-in-part), teaches the use of a preferred degermination and rolling process to avoid breakage of the germ. These patents also teach the separation of degermination products into three streams, one of which is a "fine" stream relative to the others (see FIGS. 6, 7, and 8 of the '313 patent and accompanying text). The '313 and '503 patents specifically teach the reintroduction of this fine stream into the other less carefully graded streams after the other streams have been subjected to various other steps, such as tempering and drying (See claim 8 of the '503 patent). The '313 and '503 patents therefore specifically teach the separation or gradation of post degermination product for the purpose of avoiding the addition of moisture to the separated fines (See '313 patent, Col. 11, Lines 4–14) followed by the subsequent reintroduction of the fine stream into a mixed stream. With only a reference to fines, these patents do not teach or provide motivation to isolate finished product streams as early in the milling process as a post degermination sifting. In fact, the '313 patent teaches a process wherein the product stream from the degerminator to the first break roll comprises bran, endosperm and germ. In addition, the reintroduction of the sifted "fines" streams into other streams "contaminates" the sifted stream and increase the flow across subsequent sifters.

FIG. 9 of the '313 patent does disclose a process wherein a combined stream having germ, grit, meal, and flour-sized particles, immediately downstream of a degerminator sifter, is passed to a secondary grading sifter and aspiration processes to separate flour, meal, brewer's grits, and a feed/oil recovery product without post-degermination rolling. It is shown, however, that the process of FIG. 9 in the '313 patent specifically depends upon the preferred degerminator described in the '313 patent and its parent applications. The '313 patent specifically distinguished its preferred degerminator over impact-type degerminators. The preferred degerminator of the '313 patent is described therein and claimed in the '503 patent, claim 1, et. seq.; U.S. Pat. No. 4,301,183, claim 1 et. seq.; and U.S. Pat. No. 4,365,546.

SUMMARY OF THE INVENTION

The present invention is an improvement upon the prior art in that the present invention does not contaminate or intermix the separated streams with less specifically graded streams once the finished product stream has been isolated. This results in a dramatic decrease in handling and a reduction or elimination of flow across subsequent process steps. This also increases the through-put of product allowing for the processing of an increased volume of corn in a given time, or allows for the elimination of excess processing equipment. By contrast, the net result of the process taught in the '313 and '503 patents is the contamination of the initially separated fine stream. In the present invention, a sifted end-product-grade stream is obtained from the degermination sifting or grading step and is directed towards storage or finished product handling (storage, packaging, quality control, etc.). If mixing of this stream occurs, it involves the blending of similarly sifted streams having particles of the same gradations, i.e., addition of a similar finished product stream.

The present invention is a short flow corn mill having a dramatically reduced number of process steps with a commensurate reduction in processing and handling equipment, process monitoring and maintenance labor costs, and process space requirements. This mill design utilizes fewer, but more aggressive break subsystems instead of 5 gradual break subsystems to appropriately shorten the flow while providing exceptional quality and yield performance. The present invention may employ zero to three break rollers in series (or more if parallel operations or redundancies are desired for system stability, etc., preferably from 1 to 3 break rollers. Finished product is withdrawn from process streams when it is first separated, without further intermixing of already separated streams and without a need for further production sifting. This separation occurs early in the short mill process—as early as separation of the degermination stream. In addition, an embodiment of the present invention includes the diversion of other streams at early points in the milling process to a separate hammer-mill process for the production of flour. This diversion of product to a hammer-mill process additionally eliminates product from the stream and further reduces the amount of handling, intermixing, and possible contamination of already separated streams with product of different gradations. Further, these diversions reduce the flow on rollers and on later portions of the mill. Therefore, efficiency is achieved by the rapid isolation and removal of finished product from the stream. Further, yield as well as efficiency is improved. Average corn milling yields for this industry are 180#s (#s representing pounds) (180#s of raw corn to produce 100#s of finished product). The new short flow milling technology produces finished product with a 129# yield which is the best in the industry (it is believed that the industry best has been 135 prior to the new short flow technology).

The dramatic elimination of components and the accompanying conduits and transport equipment needed to combine such components (from as many as 450 machines to produce 260,000 #s/hr in known prior art large scale mill processes to fewer than 85 machines to produce 160,000 #s/hr), allows for tremendous space savings. Additionally, monitoring and maintenance needs can be greatly reduced with the short flow process. Of course, these benefits make possible the method of the present invention for easily transportable, on-site milling applications. Simply put, when the process may be simplified to eliminate redundancy in rolling and sifting, eliminate steps required to attain a finished product, and reduce monitoring and maintenance needs, the milling process may be taken from an isolated production facility and milling may be instituted on location.

BRIEF DESCRIPTION OF THE DRAWINGS

FIG. 5 is a block diagram of the short flow grain milling process in a first preferred embodiment.

FIG. 6 is a block diagram of the short flow grain milling process in a second preferred embodiment.

FIG. 7 is a table of preferred corrugation, roller configuration, and roller gap product goals.

DETAILED DESCRIPTION OF THE INVENTION

In the present invention, kernels are received and the kernels may, optionally, be pre-treated in any manner required to maximize the production of the desired end product (grits, meal, flour, etc.). For example, the corn is most commonly cleaned through impact de-infestation or washing. The choice of a cleaning method will depend upon the desired end product, as even the cleaning steps may result in breakage of kernels or an alteration in the moisture content. Additionally, pre-treatment may involve tempering or moisturizing of the corn with water, hot water and/or steam, although this is not necessary.

Figure 1:
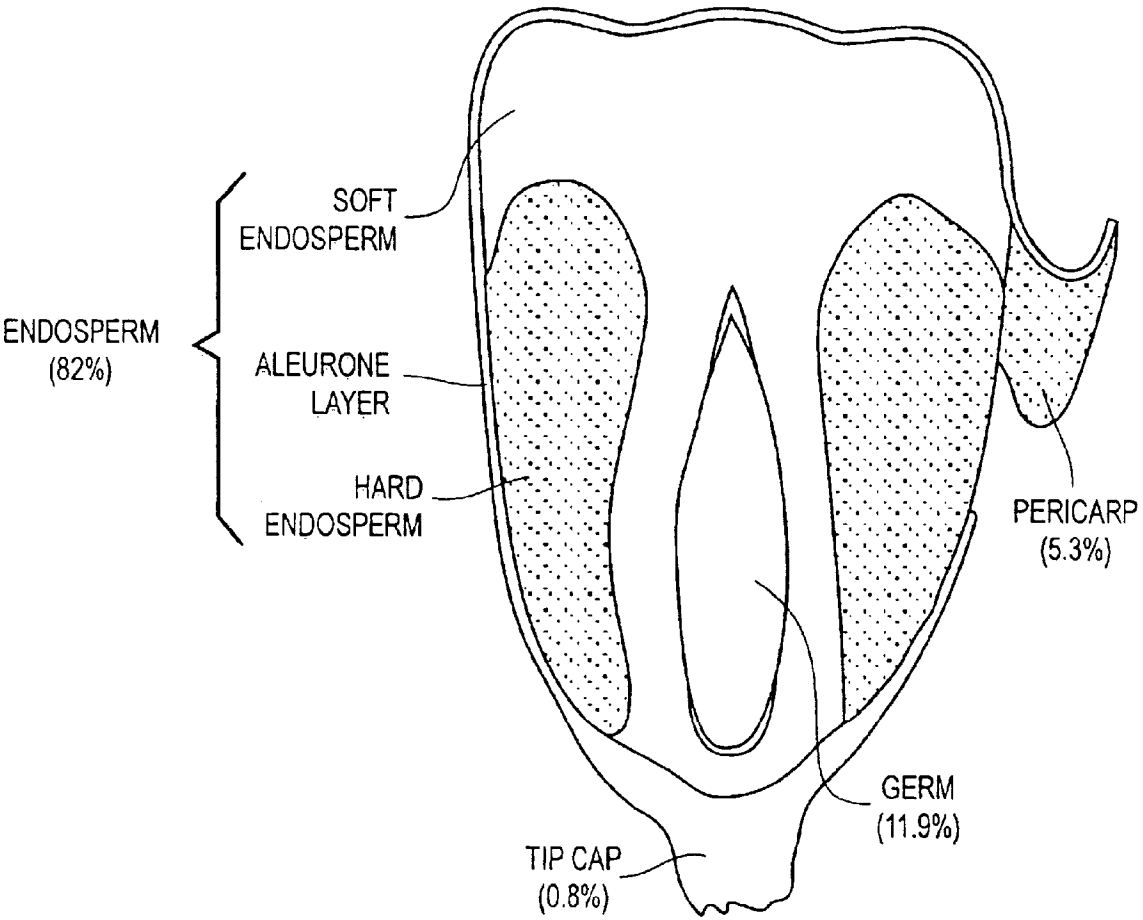
FIG. 1 is a enlarged diagram of a kernel of corn to display the constituent portions of the kernel.
Figure 2:
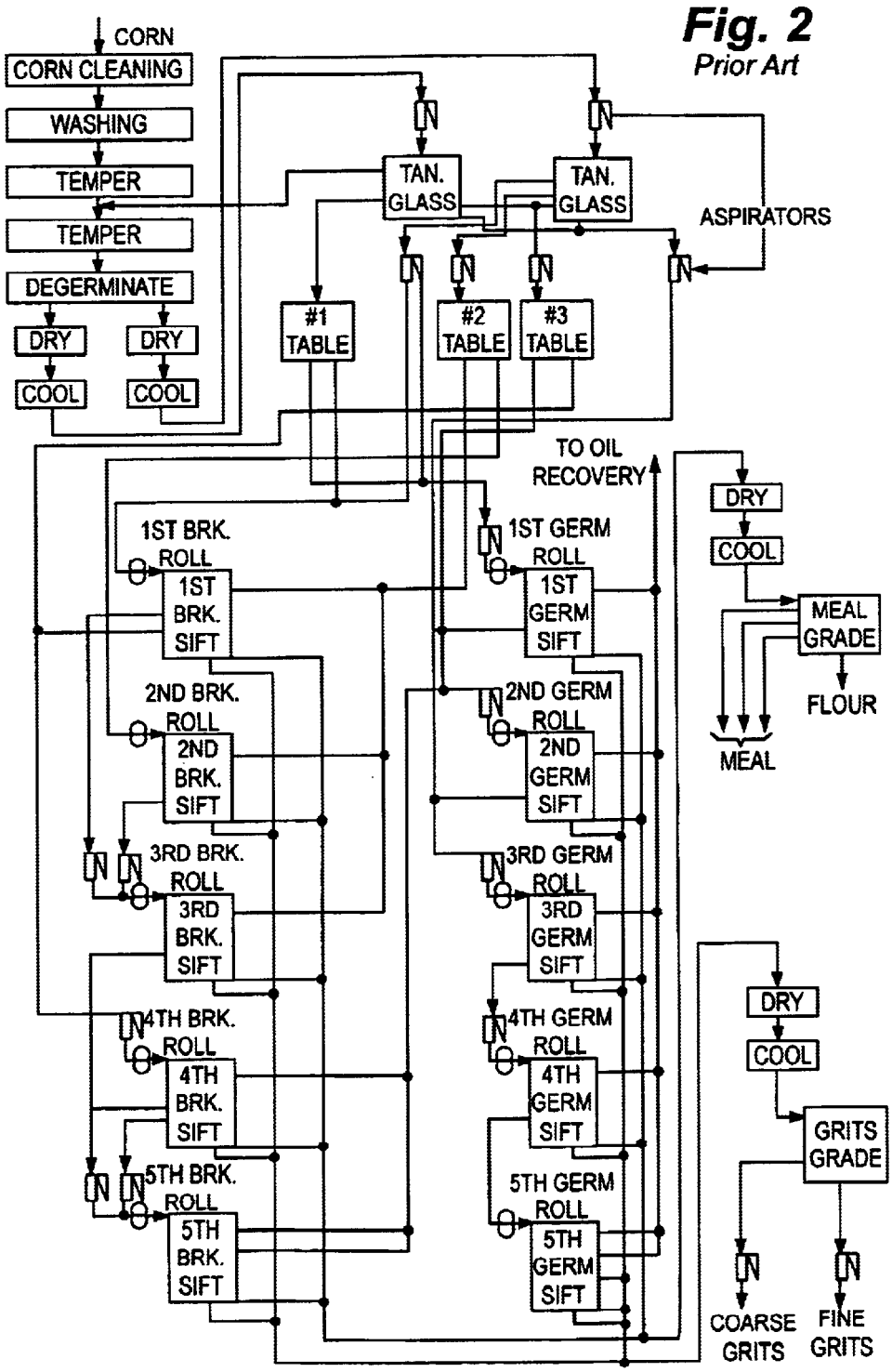
Fig. 2 Prior Art
FIG. 2 is a flowchart of a typical prior art gradual break milling process.
Figure 3:
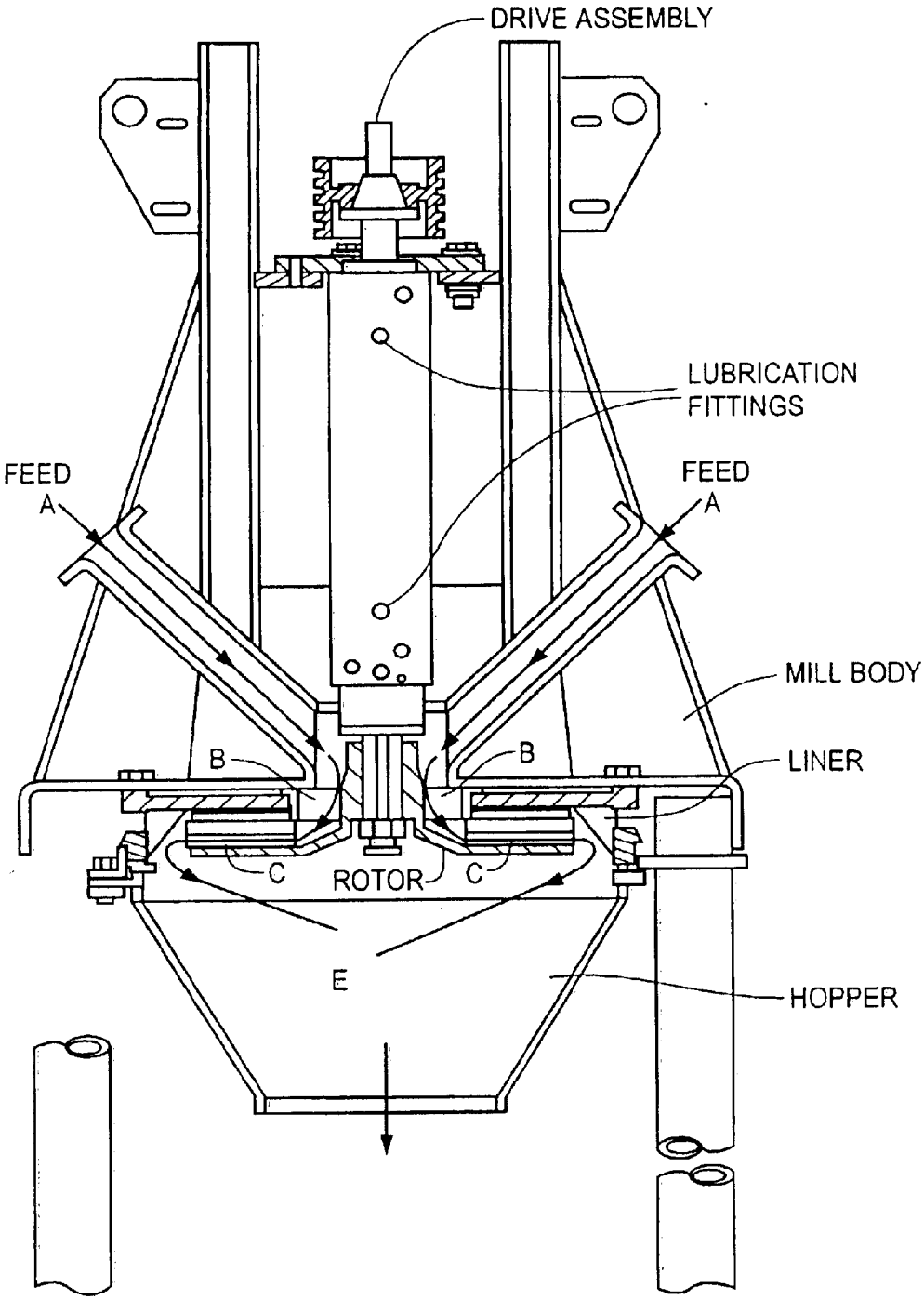
Fig. 3 Prior Art
FIG. 3 is a front elevational view of a prior art Entoletor impact degerminator.
Figure 4:
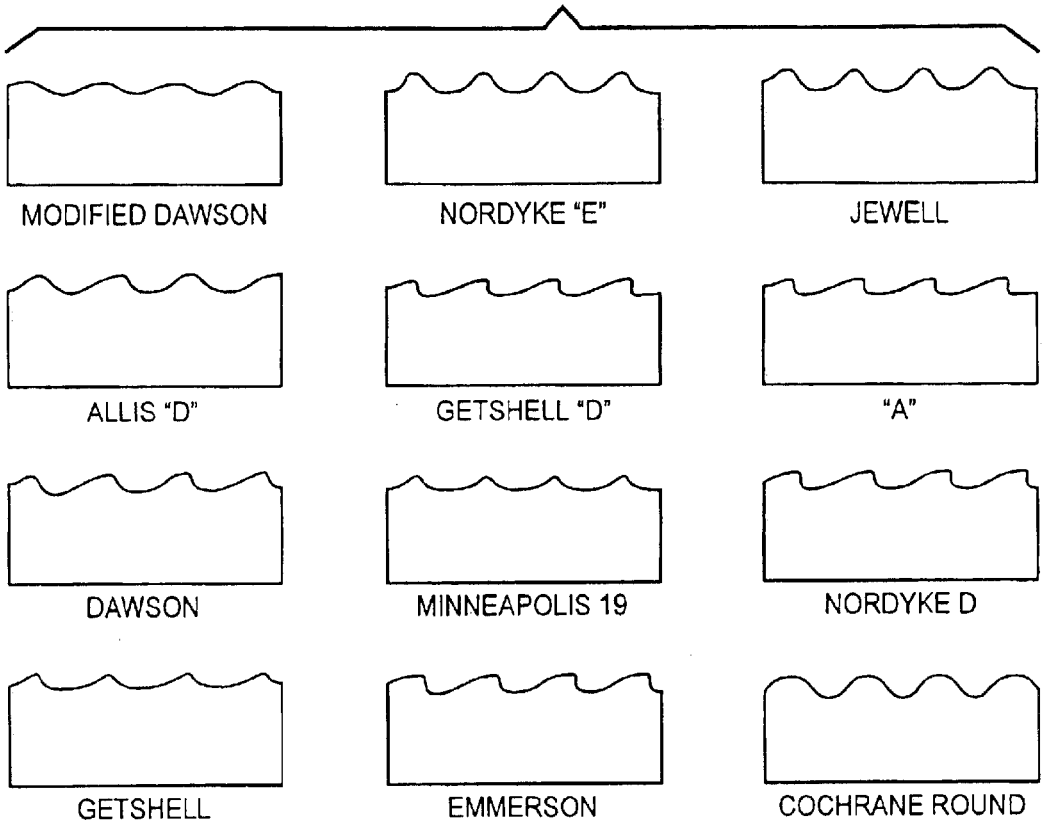
Fig. 4 Prior Art
FIG. 4 is an illustration of prior art break roller corrugations.

Because the corn kernel's constituent parts, as illustrated in FIG. 1 and as discussed above, comprise separate components of distinct character, each absorbs moisture differently and this differential absorption impacts degermination efficacy. For example, the pericarp or bran coat may be brittle without tempering, but tempering creates a more pliable bran coat that is more likely to be removed intact or as a particle of larger size. Similarly, tempering may aid the release of the germ still in connection with the tip-cap. This allows the removal of the tip-cap with the germ and a reduction in the number of black tip-caps that may be further milled and result in discoloration of the finished product. In fact, the '313 patent teaches tempering as a method for facilitating the shortened process. However, tempering necessarily increases production costs through energy expense for drying, and tempering is not necessary to practice the present invention.

After cleaning, and the optional and/or desired pre-treatment, the corn is degerminated. In the currently preferred embodiment, the corn is degermed without the use of tempering and is accomplished with an impact degerminator. This preferred method of degermination typically achieves breakage of the kernel into relatively large pieces, dislodging the germ. Degermination is followed by a separation step. Degermination may be followed by a drying step prior to separation if tempering is elected, or drying may occur later.

The post-degermination sifter is herein referred to as a "hominy grader." The hominy grader segments the broken corn into various streams depending on granulation-the size of the product granules. The finer granulated streams, such as low fat meal and flour streams are directed as finished product from the hominy grader to eliminate excessive handling and deterioration of product quality. Optionally, the meal stock may be directed towards a hammer-mill or flour grinder if greater flour output is desired. By extracting finished product as soon as possible, the mill flow can be greatly reduced as further sifting of an already isolated stream is not required.

The medium granulated streams from the hominy grader are sent directly to aggressive $2^{nd}$ and $3^{rd}$ (in series) break roll subsystems via aspirators. When sent directly to the $2^{nd}$ break roll subsystem, the stream does not pass first through the $1^{st}$ break roll subsystem. When sent directly to the $3^{rd}$ break roll subsystem, the stream does not pass first through either the $1^{st}$ or $2^{nd}$ break roll subsystems. Therefore, the present invention allows for the processing of a greater volume without increasing the load on a particular roller. The aspiration step helps to break apart combined particles and further separate any remaining bran, germ or other non-endosperm material from the endosperm material. Preferred aspirators comprise cascading angled surfaces having periodic ports in the sidewalls to allow a cross stream of air to "blow" loosened bran from the falling particles. The liftings removed via aspiration may be directed to bran processing as a high value input.

The coarse granulated streams from the hominy grader are sent to gravity tables via aspiration. From the gravity tables, a lighter germ and germ-contaminated stream may be directed onward to an oil or germ recovery process. The remaining portions of the coarse product stream are sent to the aggressive $1^{st}$ break roll (in series) via aspiration.

No whole corn kernels are sent to re-degermination since the degerminator is effectively breaking the corn in one step. From each sifting step, including the hominy grader and the post $1^{st}$, $2^{nd}$, and $3^{rd}$ break siftings, finished product flour and meal may be isolated and removed from the mill stream.

With specific reference to FIG. 5, a first preferred embodiment of the present invention operates as follows. The input corn is cleaned and degerminated prior to arrival at the hominy grader. In the hominy grader, a number 6, 12, 30, and 62 wire mesh screen is employed to separate the particles from degermination. Alternative screen sizes may be employed to produce finished product having the desired particle size profiles and ranges (for example, see 21 CFR 137 regarding classification of finished products). The overs (particles that do not pass through) the number 6 screen are directed towards a gravity table via aspiration. From the gravity table, the lighter germ and germ contaminated material is removed and directed to a germ or oil recovery process. It has been found that at or above 95% of the germ is removed from the process stream at this point. The heavier particles from the gravity table are directed to a first break roller. The overs from the number 12 screen of the hominy grader are directed towards a second break roller via aspiration. The overs from the number 30 screen of the hominy grader are directed towards a third break roller via aspiration. Finally, the overs from the number 62 screen of the hominy grader are directed onward as finished product meal, whereas those portions that pass the number 62 screen are directed onward as finished product flour. Upon inspection, typically based on fat content, the meal finished product stream may be diverted for grinding to flour.

Although the present invention is described with reference to a sharp meal obtained between number 30 and number 62 wire screens, meal may be classified or obtained from other ranges as is known to those in the art. For example, a meal top screen may range from about a number 30 to about a 46 and a meal bottom screen may range from about a 46 to about a 72. Similarly flour may be that portion that passes screens ranging from about a number 46 screen to about a number 72 screen. Therefore, although specific number wire mesh screens are referenced herein to describe the preferred embodiments, it is understood that the present invention may be practiced to achieve alternate finished product particle profiles.

The first break roller typically employs rollers having 14 corrugations per inch with a dull to dull arrangement. The roller distance is typically adjusted after production begins. These adjustments allow operators to achieve target percentages for the differently sized particles coming off the rollers-i.e., the percentage of the roller output that falls into each screen size in the post-roller sifting step. It is, however, to be understood that the corrugations, roller set-up and product output goals disclosed herein are preferred embodiments and that the present invention is intended to encompass those changes instituted to maximize the overall mill output of particular product streams (meal, flour, etc.).

From the first break roller, rolled particles are sifted with a number 12, 30, and 62 wire mesh screen. Flour and meal are removed as finished product from the milling stream, as before. The overs from the number 12 screen are sent to the second break aspirator (along with the overs from the number 12 screen of the hominy grader), and the overs of the number 30 screen are sent to the third break aspirator.

The second break rollers typically employ 14 corrugations/inch, and a dull to dull configuration. From the second break roller, rolled particles are sifted with a number 12, 30, and 62 wire mesh screen. Flour and meal are removed as finished product from the milling stream, as before. The overs from the number 12 screen are sent to the germ or oil recovery, and the overs of the number 30 screen are sent to the third break aspirator. Removal of the largest remaining particles from this step to oil recovery and germ processing further reduces the milling stream and limits the fat content of the remaining product.

The third break rollers employ 20 corrugations/inch, a dull to dull configuration. From the third break roller, rolled particles are sifted with a number 22, 30, and 62 wire mesh screen. Flour and meal are removed as finished product, as before. Overs from the 30 screen are directed to grinding, such as a hammermill process to produce flour. Overs from the 22 screen are directed towards a bran dusting step to abrade remaining bran. The bran recovered from the bran duster may be sent to a bran flour or other bran product process. The remains from the bran dusting process may, if desired be directed to re-enter the process at the hominy grader.

All grinder stock (including the overs from the number 30 screen of the third break sifter and some or all finished product meal if meal production is not desired) is ground, through a process such as hammer-milling to generate flour. Simple sifting with a flour screen (here a 62 wire screen) may be used to isolate additional finished product flour and redirect the overs of the flour screen for additional grinding. Throughout the process disclosed in FIG. 5, at sifting steps in particular, additional screens may be included. This adds the advantage of further separating streams with potentially valuable uses.

In another preferred embodiment, illustrated in FIG. 6, the streams from the gravity table separator are further divided to include diversion to a gravity table germ aspirator. From the gravity table germ aspirator, product is directed to a gravity table germ roller and sifter. The gravity table roller preferably includes 12 corrugations per inch. The gravity table germ roller sifter employs a number 12, 30, and 62 wire mesh screen. Flour and meal finished products are directed onward as before. The overs of the number 12 screen are directed to germ or oil recovery processing, and the overs of the number 30 screen are directed onward to third break rollers via aspiration. The roller setting data, corrugation data, and roller arrangement for this preferred embodiment are provided in Table 1. The preferred roller specifications presented herein for the break rollers are more typical of those roller specifications applied in later roller stages of a typical prior art system.

It has been found that the preferred embodiment described in FIG. 6 is capable of producing meal and flour in accordance with the data shown in Table 1 below. Further, Table 2 illustrates the percentage of product obtained from the various sifting steps.

TABLE 1

ROLLER SETTING DATA

| Roll | Corrugations/ inch | Roll Set Up | Prod Distribution Target | Prod Distribution Target |
|---|---|---|---|---|
| 1st Break | 14/inch | Dull to Dull | 7% + 12 mesh | 9% max + 12 mesh |
| GTG | 12/inch | Dull to Dull | 20% + 12 mesh | 22% max + 12 mesh |

TABLE 1-continued

ROLLER SETTING DATA

| Roll | Corrugations/ inch | Roll Set Up | Prod Distribution Target | Prod Distribution Target |
|---|---|---|---|---|
| 2nd Break | 14/inch | Dull to Dull | 8% + 12 mesh | 10% max + 12 mesh |
| 3rd Break | 20/inch | Dull to Dull | 3% + 22 mesh | 5% max + 22 mesh |

TABLE 2

Meal Sieving

| Meal | | Wires | % | Flour | |
|---|---|---|---|---|---|
| HOMINY GRADER SIFTER 250 CWT/HR HEAD FEED | | | | | |
| Fat | 1.40% | +20 | Trace | Fat | 1.17% |
| Moist | 11.70% | +25 | 1.14% | Moist | 12.56% |
| | | −70 | 1.00% | | |
| 1st BREAK SIFTER DISTRIBUTION 65 CWT/HR HEAD FEED | | | | | |
| Fat | 1.12% | +20 | Trace | Fat | 0.98% |
| Moist | 10.80% | +25 | 0.71% | Moist | 13.50% |
| | | −70 | 0.85% | | |
| GT GERM SIFTER DISTRIBUTION 58 CWT/HR HEAD FEED | | | | | |
| Fat | 3.51% | +20 | Trace | Fat | 2.26% |
| Moist | 13.26% | +25 | 0.86% | Moist | 12.70% |
| | | −70 | 0.22% | | |

Meal Sieving

| Meal | | Wires | % | Flour | |
|---|---|---|---|---|---|
| 2ND BREAK SIFTER DISTRIBUTION 86 CWT/HR HEAD FEED | | | | | |
| Fat | 1.33% | +20 | Trace | Fat | 1.49% |
| Moist | 13.55% | +25 | 1.54% | Moist | 13.12% |
| | | −70 | 0.34% | | |
| 3RD BREAK SIFTER DISTRIBUTION 152 CWT/HR HEAD FEED | | | | | |
| Fat | 1.22% | +20 | Trace | | |
| Moist | 13.10% | +25 | 0.70% | | |
| | | −70 | 0.02% | | |

It will be apparent to those skilled in the art that the short flow design provides a finished product much faster in the milling process than typical full scale milling operations (hominy grader vs. 1st or 2nd break sifter). Each break sifter on the short flow produces finished product as contrasted with typical milling methods where secondary handling and sifting are required. Further, intermediate product streams are reduced to flour unlike other systems which use germ, tailings and purifier subsystems to reclaim poorer quality meal streams. This provides very high quality meal/flour with minimal equipment, reduced monitoring and maintenance needs, and superior yield performance. The basic milling philosophy behind the development of a shorter corn milling flow is to produce finished product faster, cheaper and better. This and the other objectives of the present invention are achieved through the application of the preferred mode and the invention as claimed herein.

Having thus described the invention in connection with the preferred embodiment thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A method for processing kernels of grain in a mill stream to produce a desired end product comprising the steps of:

cleaning the kernels of grain;

breaking the kernels of grain into two or more parts;

separating the parts according to selected size classes wherein at least one separation step occurs directly after each breaking step;

removing at least one of said size classes from the mill stream directly from each separation step.

2. The method as described in claim 1 wherein the grain is corn.

3. The method of claim 1 further comprising the steps of:

diverting one or more of the remaining size classes to a germ oil recovery process;

diverting one or more of the remaining size classes of grain to an aspirator and aspirating said size class of grain;

diverting the aspirated grain to a roller.

4. A method for processing kernels of grain in a mill stream to produce a desired end product comprising the steps of:

cleaning the kernels of grain;

degerminating the cleaned kernels of grain;

separating the degerminated kernels of grain into selected size classes using at least two separation steps wherein the first separation step occurs directly after degermination;

breaking the grain further using break rollers in-between separation steps;

removing at least one of said size classes from the mill stream directly from each separation step;

diverting the remaining size classes to one or more other locations.

5. The method of claim 4 wherein the grain is corn.

6. The method of claim 1 wherein two of the size classes removed from the mill stream after the first separation step are flour and meal.

7. A method for processing kernels of corn in a mill stream to produce a desired end product comprising the steps of:

cleaning the kernels of corn;

degerminating the cleaned kernels of corn;

separating the parts according to selected size classes in a first separation step wherein the first separation step occurs immediately after degermination;

removing at least one of said size classes from the mill stream as the desired end product directly from the first separation step;

diverting at least one of the remaining size classes from the first separation step to a first break roller having predetermined roller settings which breaks that size class into two or more parts, separating the parts according to size class in a second separation step immediately after they pass through the first break roller, removing at least one of said size classes from the mill stream directly from the second separation step, directing the remaining size classes to one or more other locations;

diverting at least one of the remaining size classes from the first separation step to a second break roller having predetermined roller settings which breaks that size class into two or more parts, separating the parts according to size class in a third separation step immediately after they pass through the second break roller, removing at least one of said size classes from the mill stream directly from the third separation step, directing the remaining size classes to one or more other locations; and diverting at least one of the remaining size classes from the first separation step to a third break roller having predetermined roller settings which breaks that size class into two or more parts, separating the parts according to size class in a fourth separation step immediately after they pass through the third break roller, removing at least one of said size classes from the mill stream directly from the fourth separation step, directing the remaining size classes to one or more other locations.

8. The method of claim 7 wherein two of the size classes removed from the mill stream after the first, second, third, and fourth, separation steps are flour and meal.

9. The method of claim 7 wherein the first and third break roller steps comprise rollers having different roller settings.

10. The method of claim 7 wherein at least one of the remaining size classes after the second separation step is directed to the second break roller and at least one of the remaining size classes after the second separation step is directed to the third break roller; and at least one of the remaining size classes after the third separation step is directed to the third break roller.

11. The method of claim 7 wherein the first and second break roller steps comprise rollers having the same roller settings.

* * * * *